US006312273B1

(12) United States Patent
Hasegawa et al.

(10) Patent No.: US 6,312,273 B1
(45) Date of Patent: Nov. 6, 2001

(54) LEVER-TYPE ELECTRICAL CONNECTOR

(75) Inventors: Teruaki Hasegawa; Naoya Kurimoto, both of Yokkaichi (JP)

(73) Assignee: Sumitomo Wiring Systems, Mie (JP)

( * ) Notice: Subject to any disclaimer, the term of this patent is extended or adjusted under 35 U.S.C. 154(b) by 0 days.

(21) Appl. No.: 09/643,744

(22) Filed: Aug. 23, 2000

(30) Foreign Application Priority Data

Sep. 9, 1999 (JP) ..... 11-256306

(51) Int. Cl.[7] ..... H01R 13/62
(52) U.S. Cl. ..... 439/157; 439/153
(58) Field of Search ..... 439/157, 160, 439/372

(56) References Cited

U.S. PATENT DOCUMENTS 6,164,992 * 12/2000 Okabe ..... 439/157

FOREIGN PATENT DOCUMENTS 1-9632870 2/1997 (DE) .
0-549371 6/1993 (EP) .
0-722203 7/1996 (EP) .
0-843386 5/1998 (EP) .
0-883212 12/1998 (EP) .
11-026070 1/1999 (JP) .
11-26070 1/1999 (JP) .

* cited by examiner

*Primary Examiner*—Gary Paumen
*Assistant Examiner*—Alexander Gilman
(74) *Attorney, Agent, or Firm*—Oliff & Berridge PLC

(57) ABSTRACT

A lever-type electrical connector has first and second matable connector parts and a lever. The lever is rotatably mounted on the first connector part and has an actuator bar at one end, and two spaced side members extending from the actuator bar alongside the side walls of the first connector part. The second connector part has a hood portion for housing the first connector part and the lever in the connected position. Support of the hood portion, in use engage end portions of the lever so that when the actuator bar is depressed from a starting position to a fully depressed position the lever pivots on the supports to lever the first connector part into the hood portion. To achieve smooth operation of the lever, the lower rear ends of the side walls of the lever and the side walls of the hood portion are shaped so that, at least when the end portions of the lever are in contact with the supports of the hood during the operation of the lever to lever the first connector part into the hood portion, the lower rear ends of the lever side walls are located between the side walls of the hood portion.

4 Claims, 7 Drawing Sheets

LEVER-TYPE ELECTRICAL CONNECTOR

BACKGROUND OF THE INVENTION

1. Field of the Invention

The present invention relates to a lever-type electrical connector in which matable connector parts containing electrical elements to be connected are drawn together towards their connected position by a rotatable lever. Such a connector has application for example in the connection of bundles of wires in a motor vehicle.

2. Description of the Related Art

An example of a lever-type connector for use in a junction box is disclosed in JP-A-11-26070. The construction of this lever-type connector is shown in present FIGS. 9 and 10. A lever 2 is supported by a female connector 1 via a shaft 4. The lever 2 has a pair of lever walls 2A which are connected by an actuator portion 3 which straddles the female connector 1. A male connector 5 mounted directly on a junction box has a hood part 6 in which the lever 2 and the female connector 1 fit.

The lever 2 when mounted on the female connector 1, has projections 7 at its front end at the lower side. The female connector 1 is then inserted into the hood part 6. As shown in FIG. 10A, the projections 7 of the lever 2 engage in a cutout 8 formed on a wall of the hood part 6. The actuator portion 3 is pressed by the user as shown by the arrow of FIG. 10A to pivot the lever 2 on the edge of the cutout 8. As a result, as shown in FIG. 10B, only a relatively small force is needed to fit the female connector 1 deeply into the hood part 6, the shaft 4 supporting the lever 2 and acting as the point of application of downwards force on the female connector 1.

However, in this lever-type connector, before the lever 2 is pressed downwardly, there is a large gap between the hood part 6 and the actuator portion 3, as shown in FIG. 10A. Therefore, there is nothing to support the two sides (the sides along the lever walls 2A) of the actuator portion 3, and because the lever 2 is only loosely supported by the shaft 4, when the lever 2 is pressed into the hood part 6 the lever 2 is liable to be deformed. Thus, pivoting movement of the lever 2 may not occur smoothly.

SUMMARY OF THE INVENTION

It is an object of the present invention to promote a smooth pivoting motion of the lever in a lever-type electrical connector.

According to the present invention, there is provided a lever-type connector comprising first and second matable connector parts and a lever. The first connector part has a front face, a rear face, two opposite ends and two opposite side walls extending between the ends. The lever is rotatably mounted on the first connector part and has an actuator portion at one end, which is operated by the user. The lever further has two spaced side members extending from the actuator portion alongside the side walls of the first connector part, and at least one engaging portion remote from the actuator portion.

The second connector part has a hood portion for housing the first connector part and the lever in the connected position. The hood portion has opposed side walls and at least one lever support.

When connecting the connector parts, the first connector part is received in the hood portion with its front face towards the second connector part. The engaging portion of the lever is engaged with the lever support, so that when the actuator portion is depressed from a starting position to a fully depressed position the lever pivots on the lever support whereby the first connector part is levered into the hood portion.

The actuator portion of the lever and the side walls of the hood portion are shaped so that, at least when the engaging portion is in contact with the lever support during the operation of the lever to lever the first connector part into the hood portion, the actuator portion is at least partially located between the side walls of the hood portion.

From the time at which the engaging portion or portions of the lever engage the lever support, the actuator portion of the lever is located between opposing side walls of the hood portion. Thus, when the actuator portion is depressed, the lever is guided by the side walls of the hood portion, and is encouraged to pivot smoothly as the first connector part mates with the second connector part.

Preferably the actuator portion of the lever comprises extension portions of its side members and a transverse member connecting these extension portions, the extension portions lying within the hood portion at the initiation of the lever action and lying beyond one said end of said first connector part in the connected position of the connector parts.

Preferably, the lever side members are rotatably mounted at respective mounting supports on the side walls of the first connector part, each mounting support being centrally located relative to a dimension of the first connector part side wall dimension which (a) is perpendicular to the direction of movement of the first connector part as it is levered into the hood portion and (b) extends between the ends of the first connector part.

The mounting supports serve as the points of application of force for pressing the first connector part into engagement with the second connector part. However, the points of force application are centrally located, and thus the first connector part can be stably balanced as it is fitted into the hood part.

Preferably, the lever has a resiliently flexible cantilevered latching arm which flexes to latch to a corresponding locking element formed on said hood portion, thereby detachably securing the lever when the actuator portion reaches the fully depressed position, the lever having a stop member to prevent excessive flexure of the latching arm when detaching it from the locking element.

When the connector parts have are fully engaged, the latching arm is engaged to the locking element. However, when the latching arm is flexed to release it from the locking element, the lever is returnable to its original position. Thus, the connector parts can be separated from each other. The stop member prevents excessive deformation of the latching arm e.g. when the free end of the latching arm strikes against the stop member.

BRIEF DESCRIPTION OF THE DRAWINGS

Embodiments of the invention will now be described by way of non-limitative example, with reference to the accompanying drawings, in which.

DETAILED DESCRIPTION OF THE PREFERRED EMBODIMENTS

Figure 1:
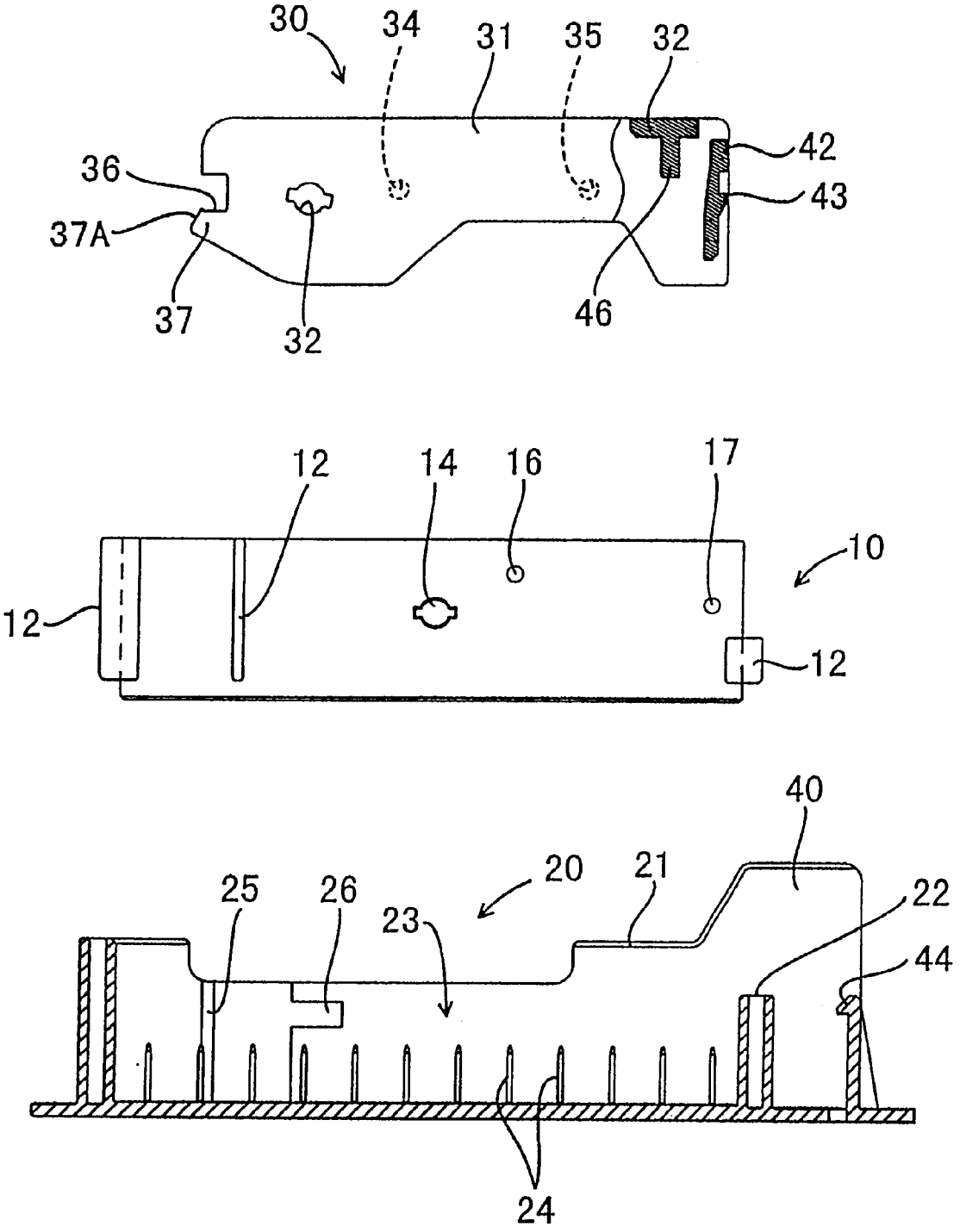
FIG. 1 is an exploded cross-sectional side view showing a lever, a female connector part, and a male connector part of a first embodiment of an electrical connector of the present invention.

As shown in FIG. 1, a lever-type electrical connector has a male connector part 20, a female connector part 10 to be fitted in the male connector part 20, and a lever 30 to be installed on the female connector part 10 (the adjectives "male" and "female" here referring to the form of the terminal fittings—housed in the respective connector parts). The lever-type connector is in this embodiment for installation on a junction box.

Figure 2:
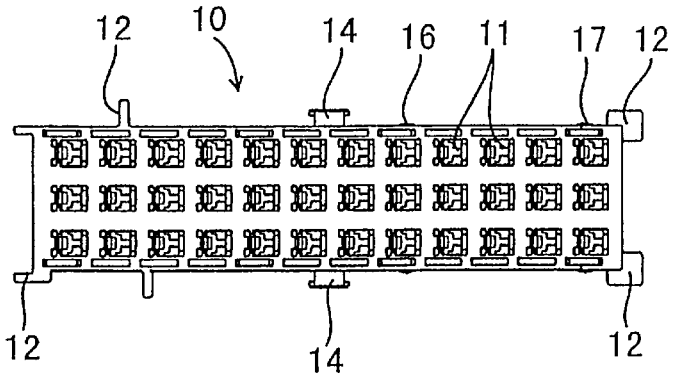
FIG. 2 is a plan view showing the female connector part of the connector of FIG. 1.

As shown in FIG. 2, the female connector part 10 is made of synthetic resin and is formed as a long and narrow block having a rear face (upper side in FIG. 1), a front face (downward side in FIG. 1), laterally extending sidewalls and opposite ends. A plurality of cavities 11 are arranged in the female connector part 10 extending from the rear to the front face. A metal female terminal fitting (not shown) is downwardly inserted into each cavity 11 from the upper side (rear face) of the female connector part 10.

Figure 3:
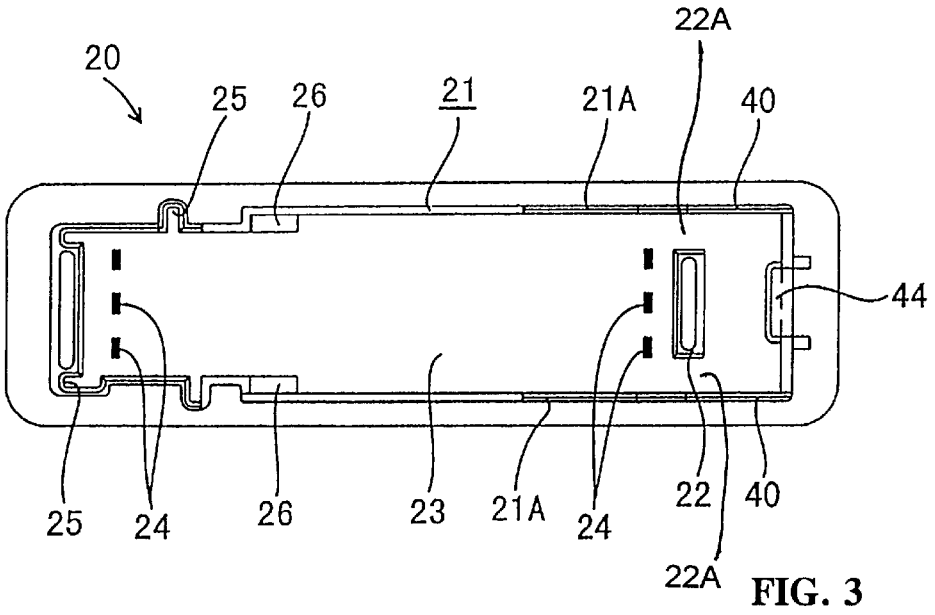
FIG. 3 is a plan view showing the male connector part of the connector of FIG. 1.

The male connector part 20 is formed on the upper surface of the junction box and has an upward facing hood part 21. As shown in FIG. 3, the hood part 21 is longer than the female connector part 10. The width of the hood part 21 at one end (left side in FIG. 3) is relatively small so that the female connector part 10 fits snugly in the male connector part 20. The hood part 21 is wider at the other end. A partition wall 22 stands up in the hood part 21 near the right end (other end) thereof. The region to the left of the partition wall 22 is a fit-in region 23 for the female connector part 10 and the region right of the partition wall 22 accommodates the actuator portion of the lever 30.

Tab-shaped metal male terminal fittings 24 project from the bottom surface of the fit-in region 23 in correspondence to the cavities 11 of the female connector part 10. The female connector part 10 is inserted with a linear motion into the fit-in region 23 of the hood part 21 by sliding ribs 12 projecting from the peripheral surface of the female connector part 10 along guide grooves 25 defined by the inner surface of the hood part 21 and into gaps 22A at the ends of the partition wall 22. When the female connector part 10 arrives at the fully inserted position, the metal male terminal fittings 24 and the metal female terminal fittings are fully connected with each other.

Figure 4:
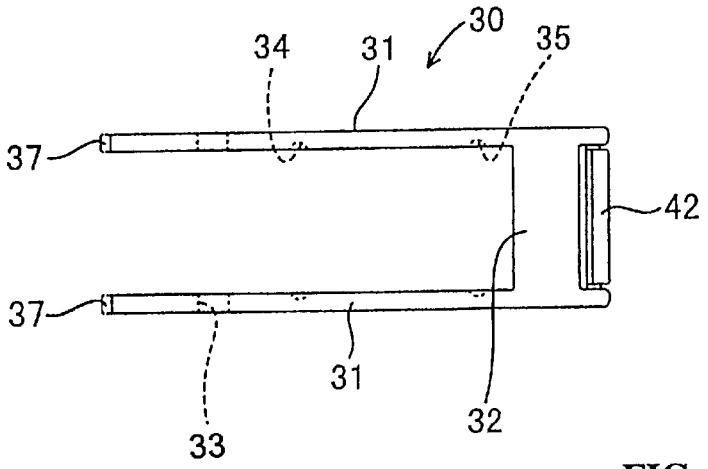
FIG. 4 is a plan view showing the lever of the connector of FIG. 1.
Figure 5:
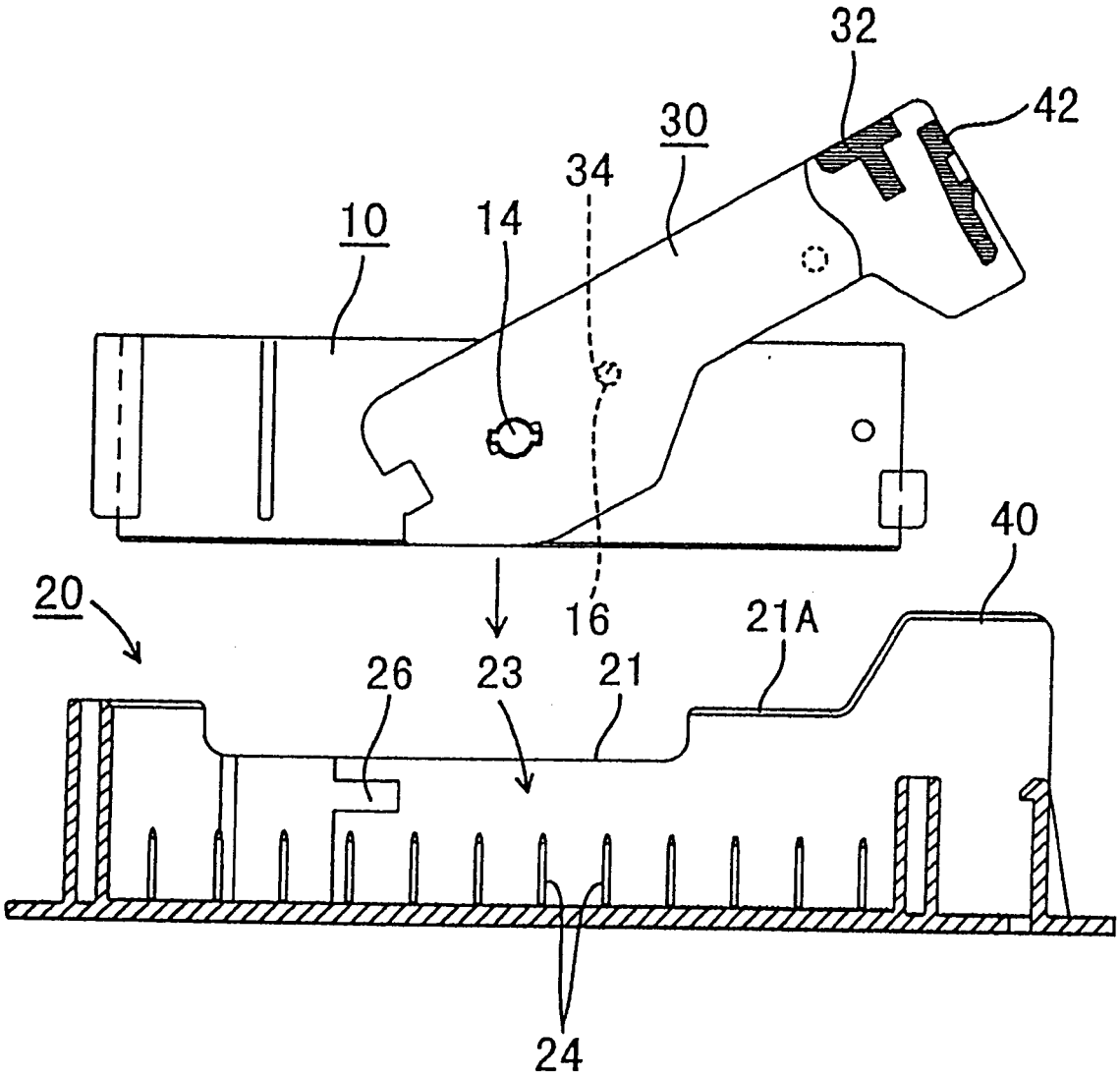
FIG. 5 is a cross-sectional side view showing connector parts as in FIG. 1 with the female connector part and the lever connected in readiness for insertion in the male connector part.

The lever 30 for providing the insertion force is mounted on the female connector part 10 as shown in FIG. 5. The upper rearward edges (i.e. to the right in FIG. 4) of a pair of lever side walls 31 are connected by a transverse actuator bar 32 to give the lever 30 a C-shaped form when viewed from above so that it can straddle both of the long sides and the short right-hand end of the female connector part 10. Together with rearward (right-hand) end portions of the side walls 31 (which in the connected position lie beyond the right-hand end of the female connector part 10, see FIG. 8), the actuator bar 32 constitutes the actuator portion of the lever.

Each lever side wall 31 has a recess at its lower edge, the recess extending approximately from the centre of the lower edge to its rear (right hand) end. A bearing hole 33 is formed towards the front end of each lever side wall 31.

A shaft 14 projects from and is centrally located relative to the elongation direction of each of the long side walls of the female connector part 10. The shafts 14 are inserted into the bearing holes 33 to support the lever 30 on the female connector part 10, with the lever 30 straddling the female connector part 10 as described above. Accordingly, when the female connector part 10 is fitted in the hood part 21, the lever 30 is accommodated in the hood part 21 at the wider portion of the hood part 21.

The lever 30 can pivot on the shafts 14 between a temporary holding position (see FIG. 5), at which the lever 30 is temporarily held with its front end lower than its rear end, and a fully locked position (see FIG. 8) in which the lever 30 is level. At the temporary holding position, the lever 30 is held by the fitting of first projections 16 formed on outer surfaces of the long side walls of the female connector part 10 to first concavities 34 formed on the inner surfaces of the lever side walls 31. At the fully locked position, the lever 30 is held by the fitting of second projections 17 formed on the outer surfaces of the long side walls of the female connector part 10 to second concavities 35 formed on the inner surfaces of the lever side walls 31.

At the front end of each lever side wall 31, an engagement projection 37 is formed below a relief groove 36. As shown in FIGS. 1 and 3, at shoulder portions of the inner surface of the hood part 21, supporting members 26 project toward the right (i.e. the rear) from a little below the upper edges of the hood part 21.

Figure 6:
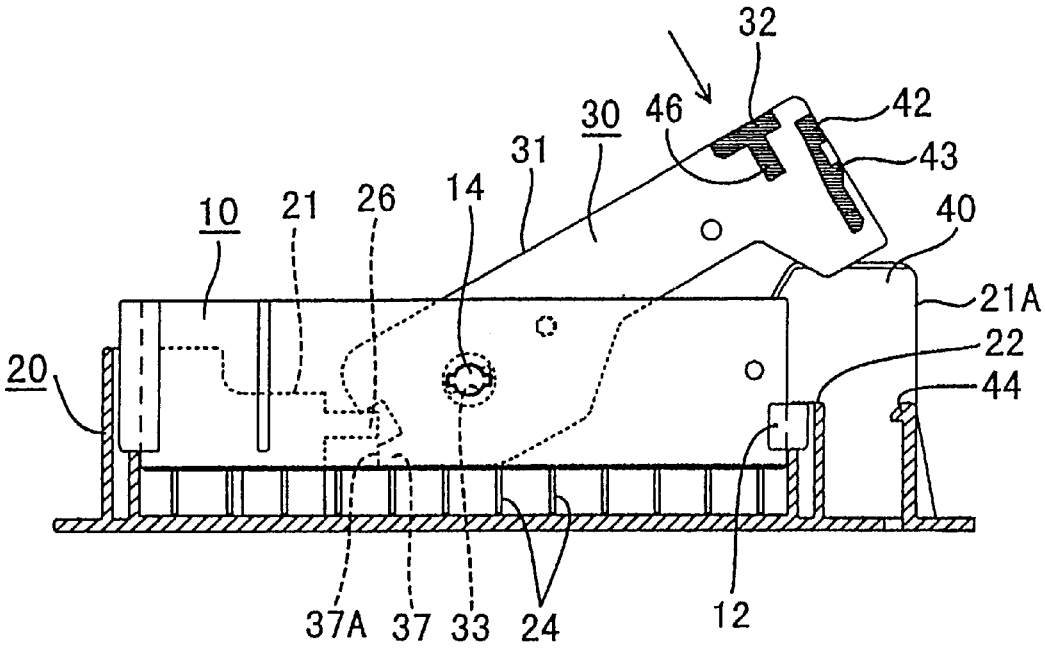
FIG. 6 is a cross-sectional view showing the connector parts of FIG. 1 immediately before the lever is actuated.

When the lever 30 is installed on the female connector part 10 at the temporary holding position thereof, the front end surface 37A (adjacent to the relief groove 36) of each engagement projection 37 lies parallel to the insertion direction of the female connector part 10. Then, when the female connector part 10 is inserted into the fit-in region 23 of the hood part 21 by a predetermined amount, each supporting member 26 is located above the level of the front end surface 37A of the engagement projection 37, as shown in FIG. 6.

Figure 7:
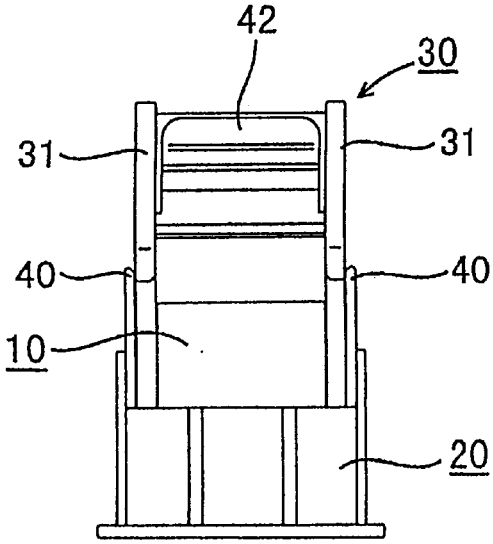
FIG. 7 is an end view of FIG. 6.

To the rear (i.e. to the right in FIG. 1) of the partition wall 22 of the hood part 21, an extension portion 40 projects upwardly from the rear end of each side wall 21A. As shown in FIGS. 6 and 7, the height of each extension portion 40 is set so that when the engagement projections 37 of the lever 30 are located below the supporting members 26 as a result of insertion of the female connector part 10 into the hood part 21, at least a portion of the rearward bottom edge of the lever 30 is sandwiched between the extended portions 40.

At the rear end of the lever 30, a locking (i.e. latching) arm 42 is formed between the lever side walls 31. The locking arm 42 is cantilever supported and elastically deformable. That is, the lower end of the locking arm 42 is fixed and its upper (free) end is deflectable. A locking projection 43 is formed on the outer side of the locking arm 42. A hook-shaped locking portion 44 to which the locking projection 43 is lockable is formed on the rear wall of the hood part 21. When the lever 30 is pivoted to its fully depressed position, the locking portion 44 locks the locking projection 43 thereto in a latch manner.

Figure 8:
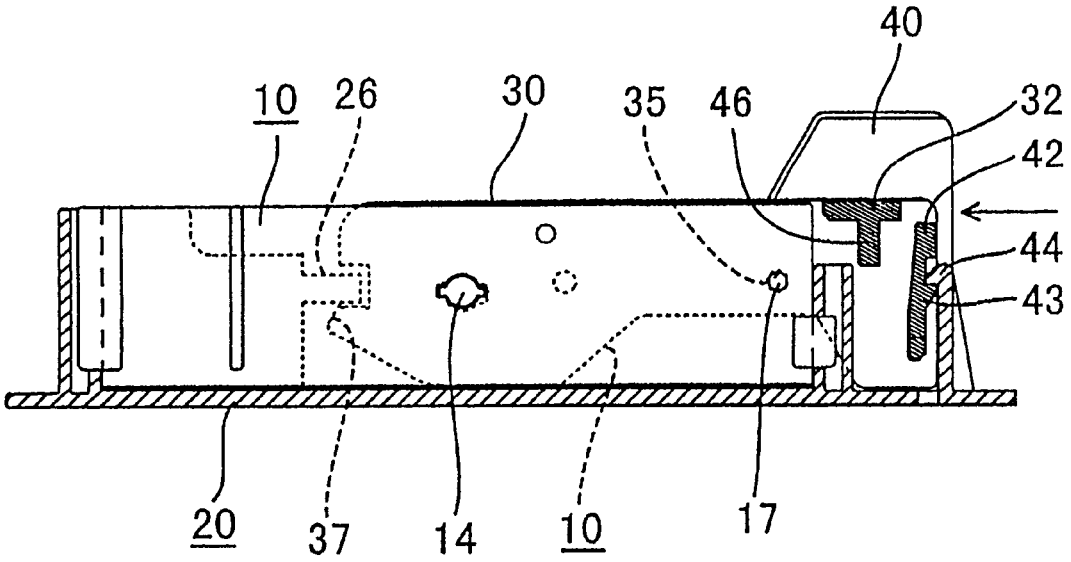
FIG. 8 is a cross-sectional side view showing the connector parts of FIG. 1 after being fitted to each other.
Figure 9:
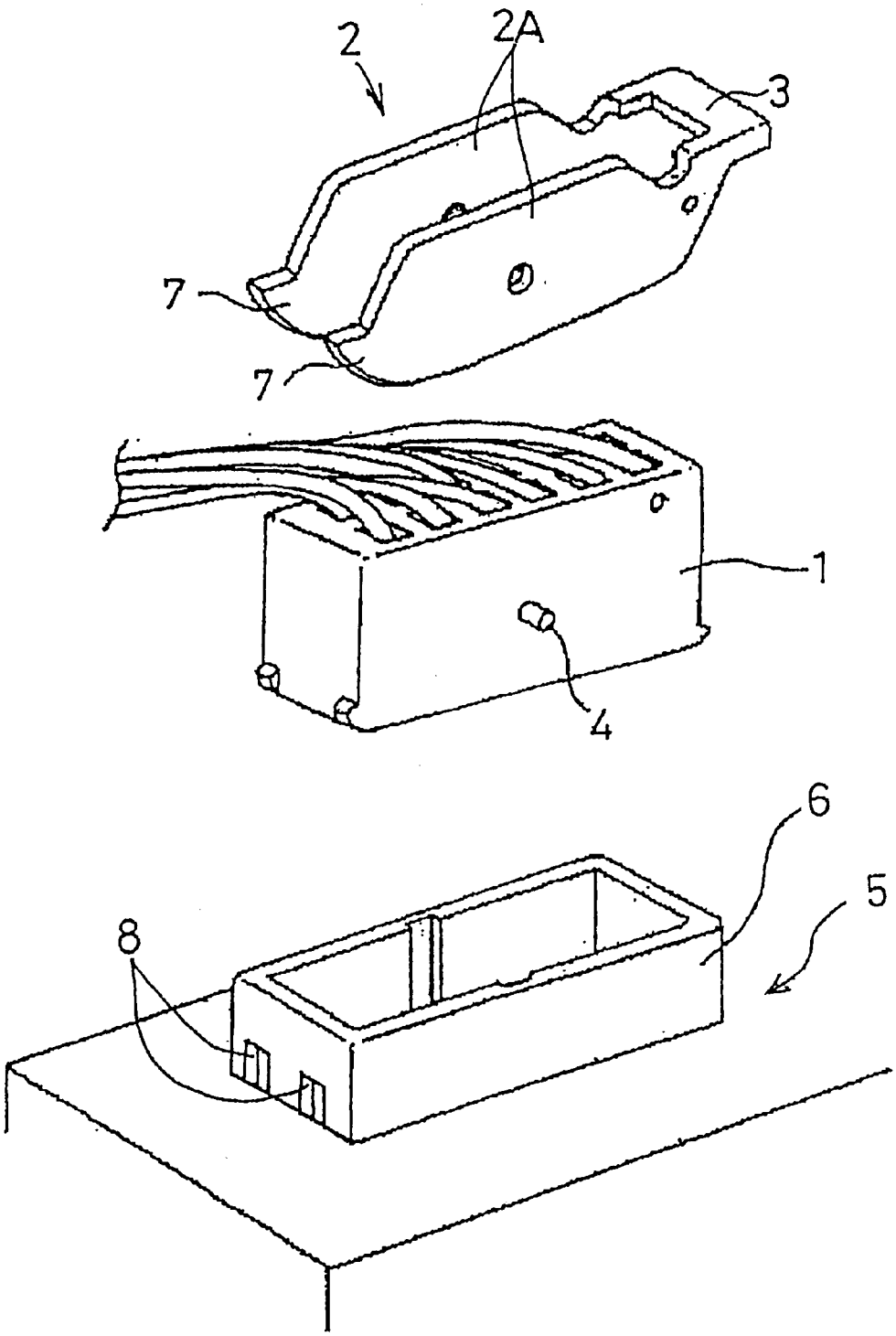
FIG. 9 PRIOR ART
FIG. 9 is an exploded perspective view showing a known lever-type connector, described above.
Figure 10A:
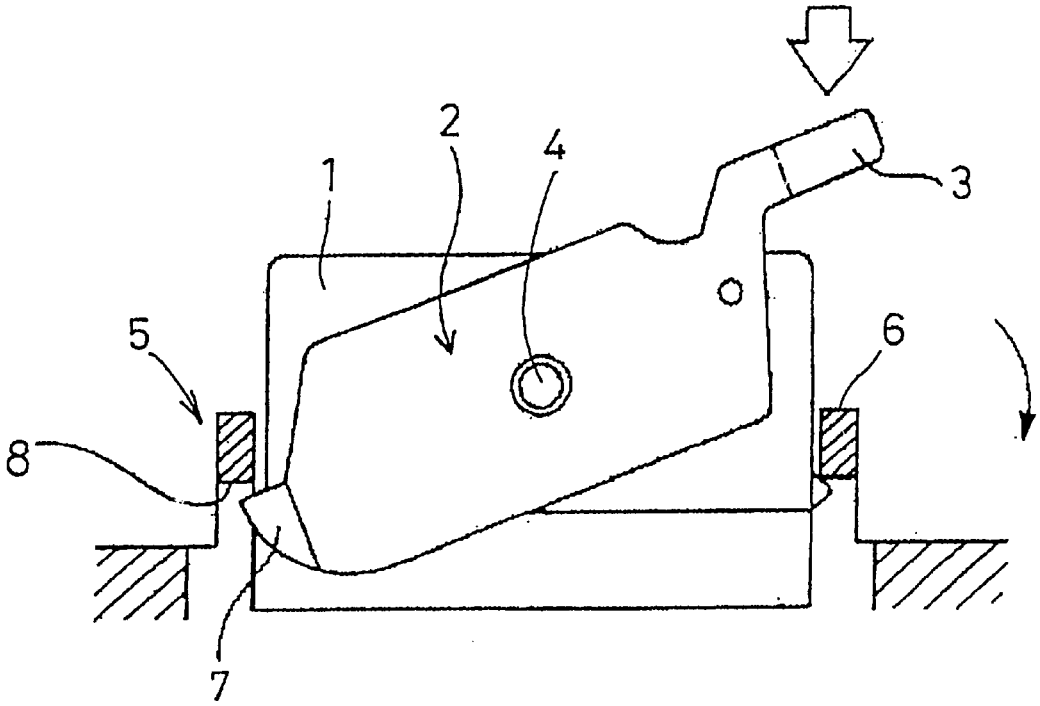
FIG. 10A PRIOR ART
FIGS. 10A and 10B are cross-sectional views showing the operation of the lever-type connector of FIG. 9.
Figure 10B:
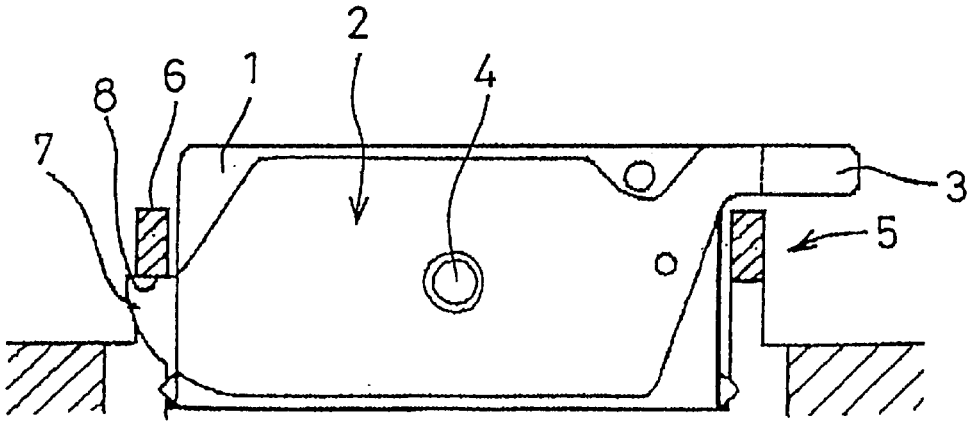
FIG. 10B PRIOR ART

As shown in FIG. 8, the locking projection 43 can be unlocked from the locking portion 44 by pressing the free end of the locking arm 42 to elastically deform the locking arm 42. Behind the free end of the locking arm 42, a restriction portion (i.e. a stop member) 46 projects downward from the lower surface of the actuator bar 32. The free end of the locking arm 42 strikes the restriction portion 46 when the free end is deflected and prevents excessive deformation of the locking arm 42.

Operation of this lever-type connector is now described The female connector part 10 accommodates the metal female terminal fittings. The lever 30 is installed on the female connector part at its temporary holding position, as shown in FIG. 5. The female connector part 10 is then inserted by a predetermined amount into the fit-in region 23 of the hood part 21 of the male connector part 20, as shown by the arrow of FIG. 5. As a result, as shown in FIG. 6, the supporting members 26 are located immediately above the engagement projections 37, and as shown in FIG. 7, a portion of each of the bottom rearward edges of the lever side walls 31 is sandwiched between the extension portions 40 of the side walls 21A of the hood part 21.

Next the actuator bar 32 of the lever 30 is depressed, as shown by the arrow of FIG. 6. As a result, the engagement projections 37 at the front end of the lever 30 are engaged by the lower surfaces of the supporting members 26. Thus, the lever 30 pivots (clockwise in FIG. 6) on the supporting members 26, and a downward force is applied to the shafts 14 of the female connector part 10, and the female connector part 10 is gradually pressed into the hood part 21.

When the lever 30 becomes approximately level, the locking arm 42 rides on the locking portion 44 and is elastically deformed. The locking projection 43 then fits to the lower side of the locking portion 44 and the locking arm 42 elastically returns to its original shape. Simultaneously the female connector part 10 arrives at the bottom surface of the hood part 21, and (as shown in FIG. 8) with the lever 30 now level, the second projections 17 fit into the second concavities 35. In this manner, the lever 30 is locked at the fully connected position.

When the free end of the locking arm 42 is pressed to deform it elastically, as shown by the arrow in FIG. 8; the locking projection 43 is unlocked from the locking portion 44. Then, the lever 30 may be pivoted counterclockwise by pushing upwardly on the lower surface of the actuator bar 32. In this manner, the female connector part 10 can be pulled apart from the hood part 21.

During unlocking of the lever 30, excessive elastic deformation of the locking arm 42 is prevented when the free end of the locking arm 42 strikes against the restriction portion 46.

From the time at which the engagement projections 37 of the lever 30 engage the supporting members 26, the bottom rearward portions of the lever 30, i.e. parts of the actuator portion of the lever, are sandwiched between the upward extension portions 40 of the side walls 21A of the hood part 21. Therefore, as the lever 30 is depressed by pushing on the actuator bar 32, the lever 30 is guided between the extension portions 40 and pivots smoothly even though it may be supported loosely on the shafts 14.

The shafts 14 act as the points of application of downwards force on the female connector part 10. Each shaft 14 is centrally located along the length of the respective side wall of the female connector part 10. Thus, the female connector part 10 is properly balanced as it is fitted in the hood part 21.

The present invention is not limited to the embodiment described above. For example, the following embodiments are included in the technical scope of the present invention.

(1) To provide a desired overlap of the actuator portion of the lever and the side walls of the hood portions, there may be downward extensions of the actuator portion, or upward extensions of the hood side walls, or as shown in the drawings both downward extensions of the actuator portion of the lever and upward extension portions of the side walls of the hood part.

(2) The present invention is applicable not only to the junction box shown in the embodiment, but also to a wire-to-wire lever-type connector.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A lever-type electrical connector comprising first and second matable connector parts and a lever, said first connector part having a front face, a rear face, two opposite ends and two opposite side walls extending between said ends, said lever being rotatably mounted on said first connector part and having an actuator portion at one end, two spaced side members extending from the actuator portion alongside said side walls of the first connector part, and at least one engaging portion remote from said actuator portion, said second connector part having a hood portion for housing said first connector part and said lever in the connected position of said connector parts, said hood portion having opposed side walls and at least one lever support and apportioned into at least a first and second accommodating space, wherein, in the operation of bringing said connector parts together to said connected position thereof, said first connector part is received in said hood portion with said front face thereof directed towards said second connector part, and said engaging portion of said lever is engaged with said lever support so that, when said actuator portion is depressed from a starting position to a fully depressed position, said lever pivots on said lever support whereby said first connector part is levered further into said hood portion towards said connected position and whereby the first connector, when in the connected position, is substantially situated in the first accommodating space and the actuator portion of the lever is substantially situated in the second accommodating space, and said actuator portion of said lever and said side walls of said hood portion being shaped so that, at least when said engaging portion is in contact with said lever support during the operation to lever said first connector part into said hood portion, said actuator portion is at least partially located between said side walls of said hood portion.

2. A lever-type connector according to claim 1, wherein said actuator portion comprises extension portions of said side members and a transverse member connecting said extension portions, said extension portions lying within said hood portion at the initiation of the lever action and lying beyond one said end of said first connector part in said connected position of the connector parts.

3. A lever-type connector according to claim 1, wherein said side members of said lever are rotatably mounted at respective mounting supports on the side walls of the first connector part, each said mounting support being centrally located relative to the dimension of the side wall of said first connector part and which (a) is formed to protrude substantially perpendicular to the faces of said side walls of said first connector part and (b) extends between said ends of the first connector part.

4. A lever-type connector according to claim 1, wherein said lever has a resiliently flexible cantilevered latching arm which flexes to latch itself to a corresponding locking element formed on said hood portion, thereby detachably securing said lever when said actuator portion reaches a fully depressed position, said lever having a stop member to prevent excessive flexure of said latching arm when detaching said latching arm from said locking element.

* * * * *